United States Patent [19]

Hwang et al.

[11] Patent Number: 4,811,682

[45] Date of Patent: Mar. 14, 1989

[54] MINI INFLATABLE YACHT

[76] Inventors: Chi Y. Hwang, No. 21, Lane 20, Chung Cheng N. Rd., Sun Chong City, Taipei Shien; Liu P. Chih, No. 29, Lane 426, Wor Long Street, Taipei City, both of Taiwan

[21] Appl. No.: 160,910

[22] Filed: Feb. 26, 1988

[51] Int. Cl.[4] ..... B63B 7/08

[52] U.S. Cl. ..... 114/345; 440/6; 272/1 B

[58] Field of Search ..... 114/345, 166; 440/6, 440/43, 67, 71, 72; 272/1 B

[56] References Cited

U.S. PATENT DOCUMENTS

| | | | |
|---|---|---|---|
| 2,139,594 | 12/1938 | Kort | 114/166 |
| 3,043,260 | 7/1962 | Tank | 440/88 |
| 3,049,731 | 8/1962 | Ertl et al. | 114/345 |
| 3,220,182 | 11/1965 | Cochran | 440/43 |
| 3,878,809 | 4/1975 | Ray | 440/6 |
| 4,329,751 | 5/1982 | Cigognetti | 114/345 |
| 4,509,926 | 4/1985 | Jacobson | 440/77 |
| 4,597,355 | 7/1986 | Kirby | 114/345 |
| 4,628,854 | 12/1986 | Harding | 114/345 |
| 4,667,618 | 5/1987 | Cigognetti | 114/345 |

FOREIGN PATENT DOCUMENTS

| | | | |
|---|---|---|---|
| 2017747 | 1/1972 | Fed. Rep. of Germany | 114/345 |
| 2155978 | 5/1973 | Fed. Rep. of Germany | 114/345 |
| 2375085 | 8/1978 | France | 114/345 |

*Primary Examiner*—Sherman D. Basinger
*Assistant Examiner*—Thomas J. Brahan
*Attorney, Agent, or Firm*—Sherman & Shalloway

[57] ABSTRACT

A mini inflatable yacht for children's use mainly comprises a mini yacht and an air-filled bladder. The mini yacht is constituted of a boat body with a lid, fitted with a handle and a seat and provided with a waterproof plate having air inlet and outlet pipes in combination with a battery, a fan and a motor mounted in the boat body; a transmitting assembly; and a propeller. The inflatable bladder has an inner flange for connecting the bladder to the boat body. When not in use, the air-filled bladder can be emptied and received under the seat of the yacht for easy carrying.

3 Claims, 7 Drawing Sheets

MINI INFLATABLE YACHT

BACKGROUND OF THE INVENTION

The present invention relates to a mini inflatable yacht.

The yachts in most amusement parks have large dimensions in considering the requirement of floating and can only be put at a steady place for use. Thus, they just provide a little amusement and can not be commonly used.

The present invention is to provide an advantageous design for utility use.

SUMMARY OF THE INVENTION

A primary purpose of the present invention is to provide a mini inflatable yacht which can be carried conveniently.

A further purpose of the present invention is to provide a mini inflatable yacht which is suitable for children.

Further purposes and advantages of the present invention will become apparent as the following description proceeds, and the features of novelty which characterize the invention will be pointed out with particularity in the claims annexed to and forming a part of this invention.

Figure 1:
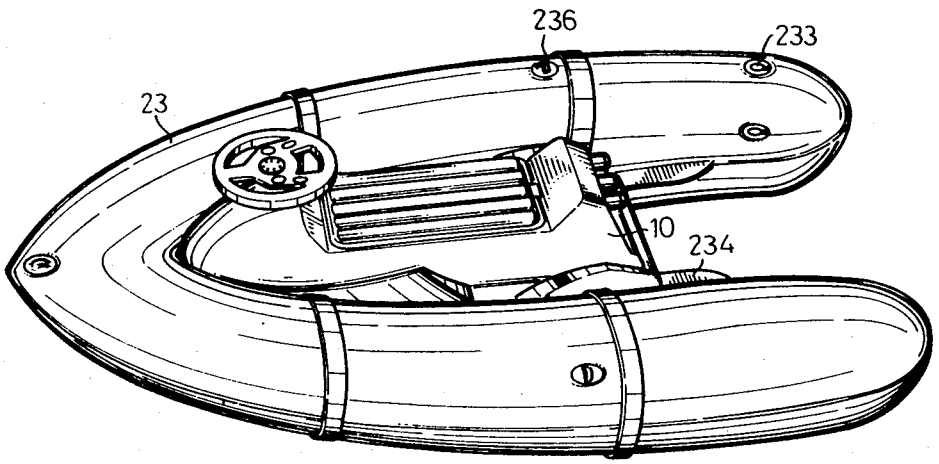
FIG. 1 is a perspective view of the mini inflatable yacht of the present invention.
Figure 2:
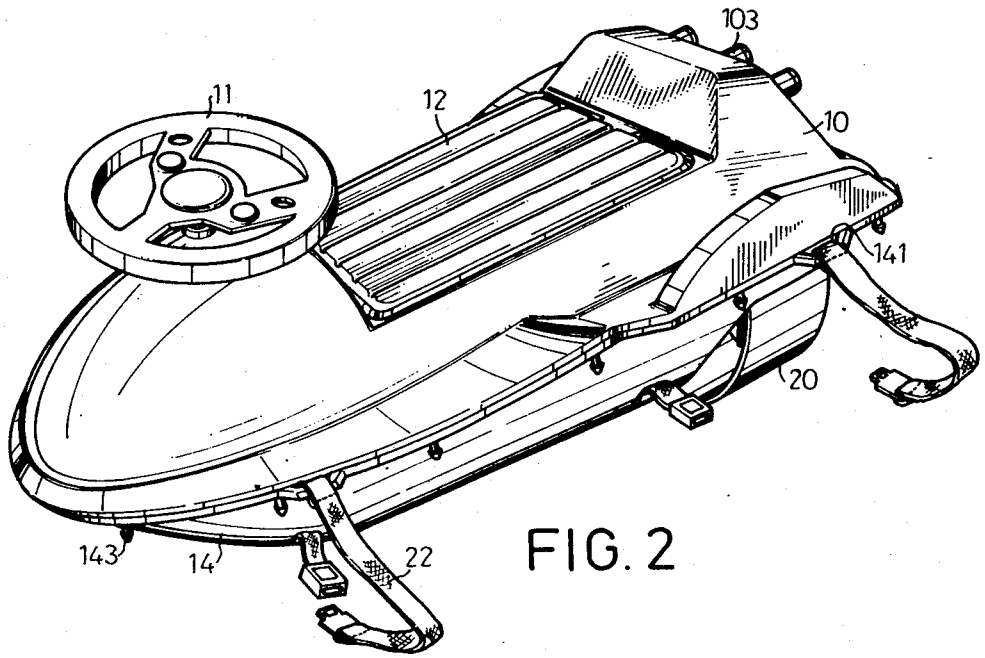
FIG. 2 is a perspective view of a single mini yacht of the present invention.
Figure 3:
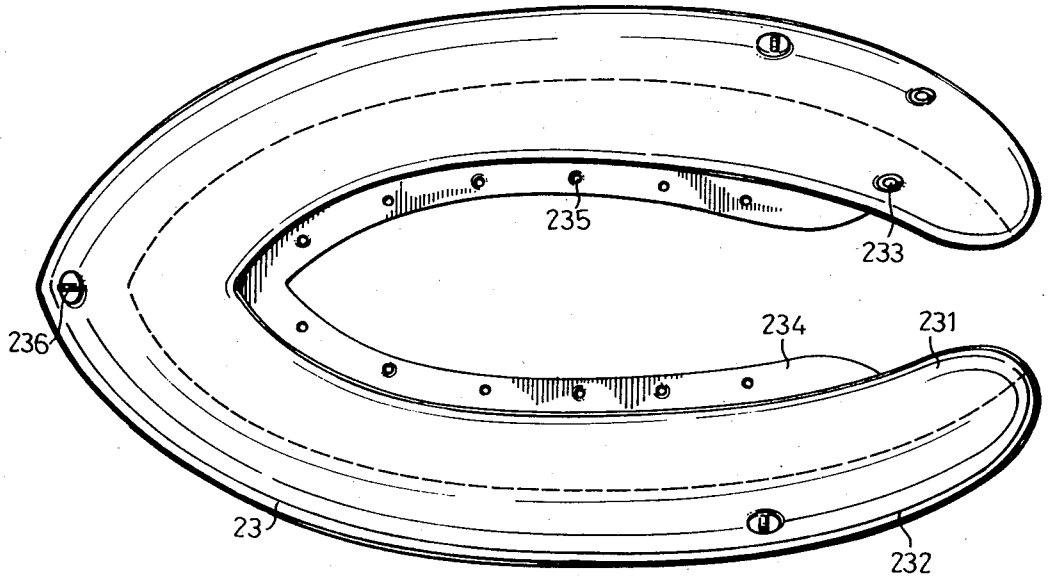
FIG. 3 is a plan view of an air-filled bladder of the present invention.
Figure 4:
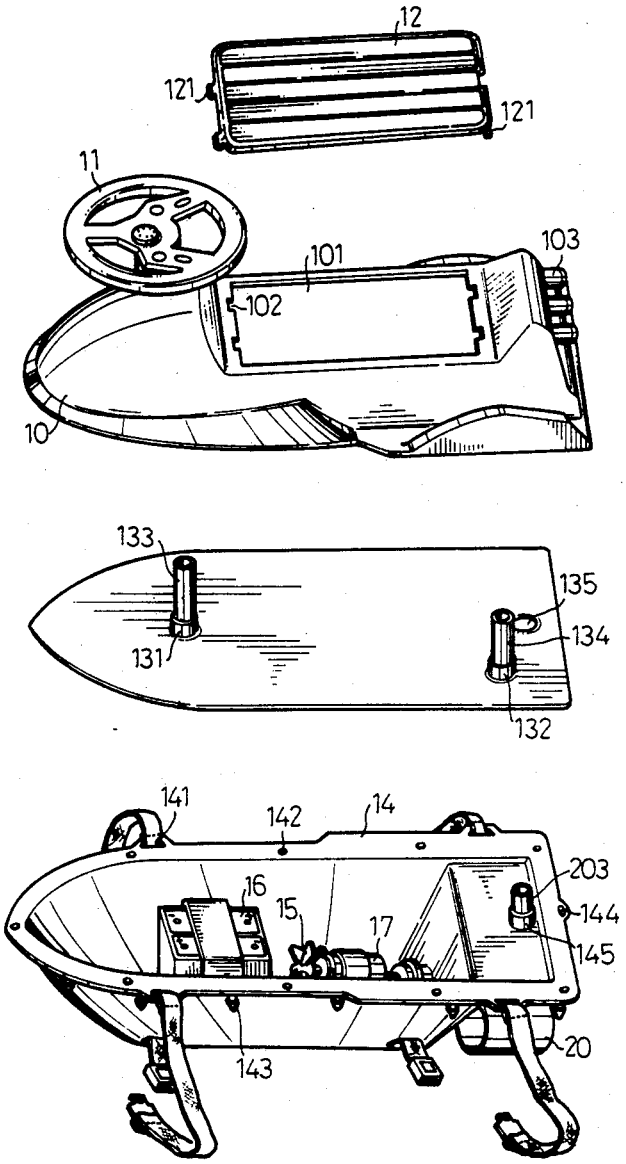
FIG. 4 is an exploded view of the mini yacht of the present invention.

According to FIGS. 1 to 4, the present invention comprises a waterproof mini yacht and an air-filled bladder, wherein the mini yacht consists of a lid 10, a handle 11, a seat 12, a waterproof plate 13, a boat body 14 and a safe rudder 20. Because the mini yacht (including a fan 15, a battery 16, a motor 17 and a transmitting assembly) will sink into water, it must be accompanyied with an air-filled bladder 23 for use. The said air-filled bladder 23 formed as a U-shaped configuration has an inner flange 234 provided with several holes 235 which can receive the pins 143 of the mini yacht and therefore the air-filled bladder which can be disposed around the mini yacht becomes a means to carry men. After use, the air-filled bladder can be deflated and folded up for storage in the chamber 101 under the seat 12 of the mini yacht for convenient carrying.

Figure 5:
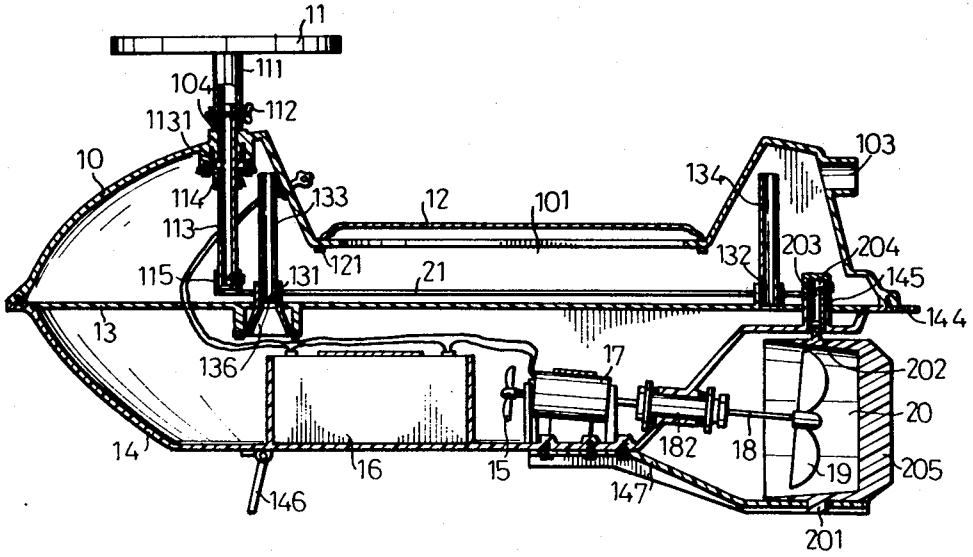
FIG. 5 is a cross-sectional view of the mini yacht of the present invention.

As shown in FIG. 5, the lid 10 of the mini yacht connects with the boat body 14 by screws (not shown) whereas the waterproof plate 13 is welded with the boat body 14 by supersonic weave. In the boat body 14 there are provided a fan 15, a battery 16, a motor 17, a speed reducing assembly, a waterproof bearing 182 and a shaft 18. After working a period of time, the motor 17 will give off heat; the fan 15 will blow the hot air through a wind hole 136, an exhaust hole 131 and an exhaust pipe

Figure 6:
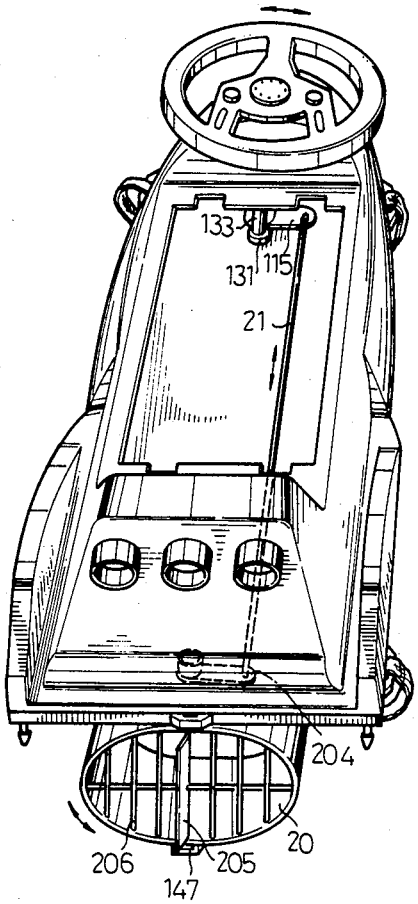
FIG. 6 is a schematic view of the handle assembly of the mini yacht of the present invention.

133, while, at the same time, the cool air will be sucked into the boat body from inlet pipe 134 and hole 132 which are disposed on the back end of the lid 10. Since the lid 10 has several apertures 103, the hot air can be blown out; however, while the outlets of the exhaust pipe 133 and inlet pipe 134 are mounted on the tip level inside the lid 10 any water is prevented from entering the boat body 14 during operating. The handle 11, in the form of a steering wheel, with a rotary shaft 111 connects with the main shaft 113 by means of a butterfly screw 112 to fix both together; while upon releasing the butterfly screw 112, the handle 11 can be separated for reducing the volume. A ring 114 is provided under a projection 1131 of the main shaft 113 so as to lead allow the main shaft 13 to rotate in the shaft hole 104 without loosening. A rotary piece 15 connected with the lower end of the main shaft 113 has provided therein a slot for connection with a rod 21 which extends to and engages with the rotary piece 204, thus, to control the handle 11 is to motivate the transmitting shaft 203 by means of a rectangular shaft end 202 fixed on a rudder plate 205 which is mounted on the center line of the bottom of the boat body 14. As shown in FIG. 6, the end of the rudder 20 has centrally provided a wider rudder plate 205 in connection with several protecting rods 206.

In order to secure the water out of entering the boat body 14 from transmitting shaft 203, it is provided with a sealed bearing 145 therebetween and coated with a layer of resin for waterproofing, further rotary flame 146 is disposed under the bottom of the boat body 14, and can be put into horizotal level during the yacht is moving on the water.

Figure 7:
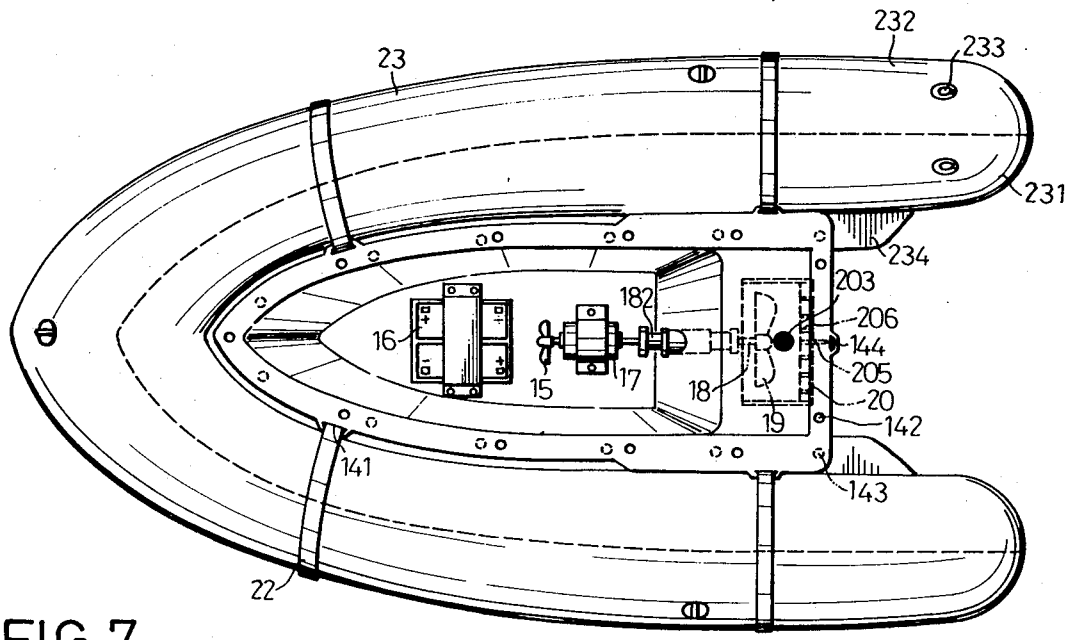
FIG. 7 is a schematic view showing the main structures of the present invention.

Referring to FIG. 7, there can be used one or two batterys and motors to increase the motivating force of the propeller 19. Further, the air-filled bladder 23 comprises an inner compartment 231 and an outer compartment 232, thereby if the outer layer 232 is broken, the inner will carry the mini yacht safely. The air-filled bladder 23 and boat body are provided with two rings 236 and 144 respectively and four belts 22 engaged with the corresponding hinge 141 for secure connection. The air-filled bladder with inner and outer compartments is provided with two valves 233 for inflation and deflation. After use, the seat 12 can be opened, the folded, deflated bladder may be placed into the chamber 101, and then the seat 12 reclosed. Moreover, in order to prevent children from using the mini yacht, it is only actuated by a key so that children can not play with the yacht without the permission of an adult.

As various possible embodiments might be made of the above invention, without departing from the scope of the invention, it is to be understood that all matter described or shown in the accompanying drawing is to be interpreted as illustrative and not in a limiting sense. Thus it will be appreciated that the drawings are exemplary of a preferred embodiment of the invention.

I claim:

1. A mini inflatable yacht comprising a mini yacht and an inflatable bladder, wherein:

said mini yacht comprises a boat body having an open top provided with an external propeller means for propelling the boat body through water;

said boat body containing an electric battery means for providing electrical power, a motor means, electrically connected to said battery means, for providing propulsive power, a transmitting assembly means for waterproofly drivingly connecting said motor means to said external propeller means, and fan means for blowing air through said boat body;

said boat body having an outer circumference and a plurality of downwardly extending pins mounted on said outer circumference;

said mini yacht further comprising a waterproof plate closing said open top of said boat body, said waterproof plate having an air inlet pipe and an air outlet pipe extending therethrough to allow circulation of air through said boat body; a lid for covering said waterproof plate, said lid provided with at least one aperture therethrough; a removable seat detachably connected to said lid, said removable seat and said lid defining a storage compartment; manually actuable rudder means, mounted on said boat body, for steering said mini yacht; handle means, operatively connected to said rudder means, for manually actuating said rudder means;

said inflatable bladder being provided with an inner flange, said inner flange being provided with a plurality of holes therethrough corresponding to said plurality of downwardly extending pins mounted on said outer circumference of said boat body, each of said plurality of holes receivable of a corresponding one of said plurality of downwardly extending pegs;

said inflatable bladder, when deflated, being foldable and said folded bladder being receivable within said storage compartment.

2. The mini inflatable yacht according to claim 1, wherein said inflatable bladder is substantially U-shaped comprising a first arm, a second arm and a central portion conjoining said first and second arm; said boat body being receivable between said first and second arms; said inflatable bladder comprising an inner compartment and an outer compartment.

3. The mini inflatable yacht according to claim 1, wherein said rudder means comprises a cylindrical housing disposed about said propeller means and pivotally connected to said boat body for rotation about a substantially vertical axis, said cylindrical housing having a substantially vertical plate member mounted thereon, said cylindrical housing having a plurality of substantially vertical rods mounted thereon to inhibit access to said propeller means.

* * * * *